United States Patent [19]

Barnett

[11] 4,411,424

[45] Oct. 25, 1983

[54] WEIGHT LIFTING EXERCISE APPARATUS

[76] Inventor: Robert V. Barnett, 904½ N.W. 91, Oklahoma City, Okla. 73114

[21] Appl. No.: 346,473

[22] Filed: Feb. 8, 1982

[51] Int. Cl.[3] ..... A63B 21/12

[52] U.S. Cl. ..... 272/118; 272/143; 272/DIG. 4; 272/134

[58] Field of Search ..... 272/118, 117, 134, 143

[56] References Cited

U.S. PATENT DOCUMENTS 3,345,067 10/1967 Smith ..... 272/134

4,125,258 11/1978 McArthur ..... 272/118

*Primary Examiner*—Richard J. Apley

*Assistant Examiner*—William R. Browne

*Attorney, Agent, or Firm*—Robert K. Rhea

[57] ABSTRACT

In a weight raising exercise device a pair of upstanding lever assemblies, pivotally mounted on an open framework, are manually moved, alternately, toward one end of the frame in a push and pull action for raising and lowering framework guided weights selectively connected alternately with the respective lever assembly by chains entrained over sprockets and engaged with the weights by switch actuated solenoids. A fulcrum axle assembly, mounted on the framework between and pivotally connected with the lever assemblies, permits both lever assemblies to be used in raising and lowering the weights.

6 Claims, 11 Drawing Figures

112
114
116
145
144
106
108
104
142

3
164
166
162
20
170
168
16
96
69
15
22
56
60
70
84
66
72
64
98
68
80
62
74
40
76
78
130
48
100
128
142
104
52
102
42
54
18

WEIGHT LIFTING EXERCISE APPARATUS

BACKGROUND OF THE INVENTION

1. Field of the Invention

The present invention relates to body building exercise devices of the weight lifting type.

2. Description of the Prior Art

Weight lifting physical exercise devices generally comprise apparatus in which the user lifts a selected weight while prone or while seated or standing lifts bars connected with weights by cables entrained over pulleys. Another type of weight lifting exercise apparatus includes a cable entrained over a pulley in which the user pulls one end of the cable toward him in a generally horizontal or upward direction.

This weight lifting exercise apparatus is distinctive over all weight lifting apparatus of which I am aware by providing upstanding pivotally interconnected lever assemblies alternately moved toward and away from the user by pivoting about horizontal axes and interconnected by a fulcrum axle mounted on a vertical shaft in which one arm of the user pulls one lever assembly connected with the weights while simultaneously pushing against the other lever assembly with his other arm.

SUMMARY OF THE INVENTION

A generally rectangular open framework defined by an elongated horizontal base and a weight guiding upright frame at one end is provided with a vertically adjustable user supporting platform at the other end of its base frame. A pair of upright lever assemblies are pivotally mounted at their depending ends on the base frame in laterally spaced relation between the platform and end frame for generally horizontal pivoting movement of their upper ends toward and away from the end frame. The lever assemblies are transversely interconnected adjacent but spaced upwardly from the base frame by a fulcrum axle assembly to move one lever assembly away from the end frame when the other lever assembly is moved toward the end frame and vice versa. The upper limit of the lever assemblies have hand grips secured thereto and are respectively connected with opposing ends of a flexible element entrained over sprockets and pulleys at the respective upper and lower limits of the end frame for lifting and lowering a selected quantity of end frame guided weights by movement of the lever assemblies toward and away from the end frame. Normally deenergized solenoids, mounted on the upper limit of the weights, are selectively energized for lifting a selected quantity of the weights by a pair of switches mounted on the upper end portion of the end frame and opened and closed by contact with the respective lever assembly as they are moved toward and away from the end frame.

The principal object is to provide a gymnastic device of the weight lifting type wherein the user, while standing, moves weight connected lever assemblies forwardly and rearwardly in an alternating pull and push action.

DESCRIPTION OF THE PREFERRED EMBODIMENT

Figures 1, 10:
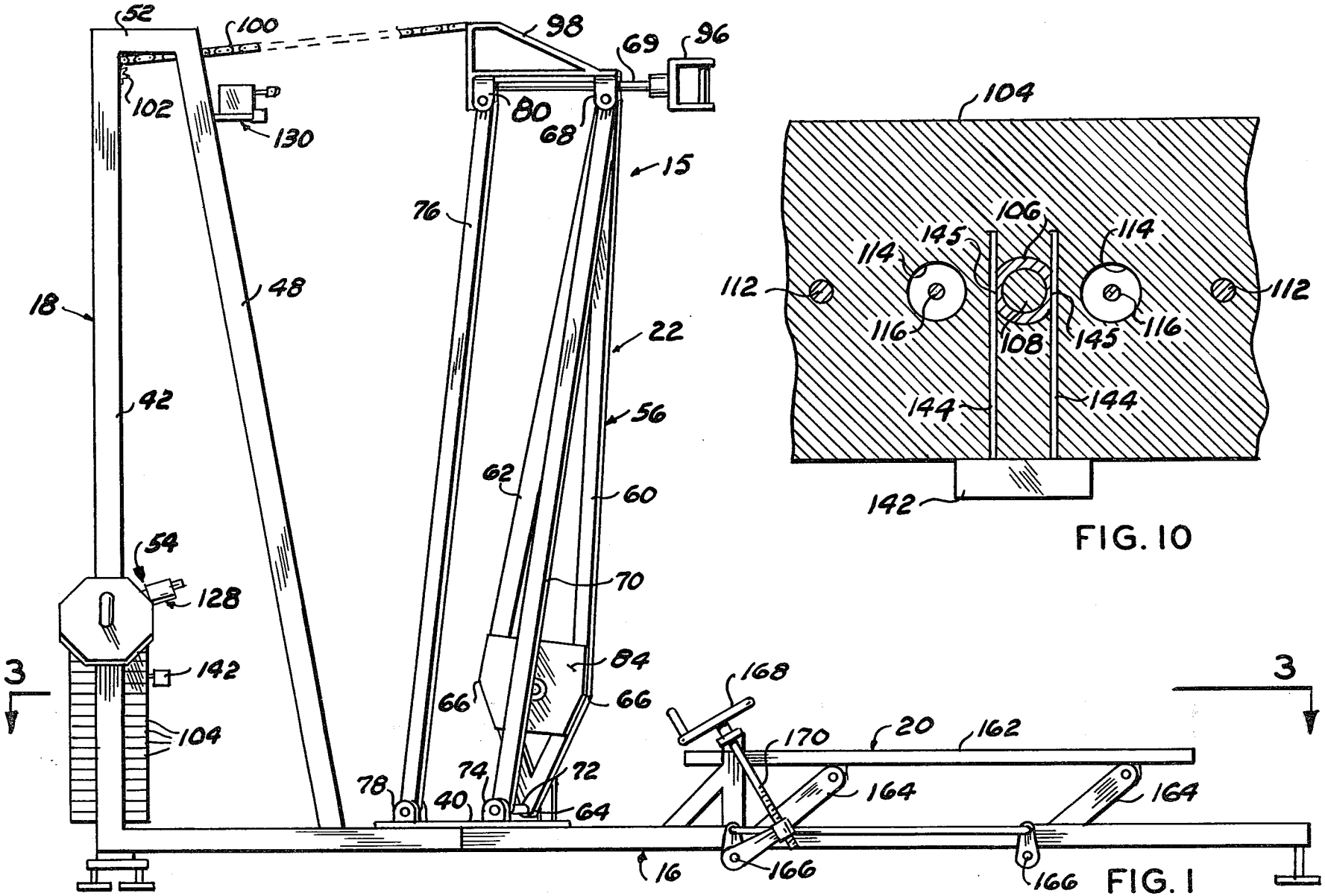
FIG. 1 is a side elevational view of the apparatus in an at rest position.
FIG. 10 is a fragmentary vertical cross sectional view taken substantially along the line 10—10 of FIG. 9; and, FIG. 11 is a fragmentary vertical cross sectional view taken substantially along the line 11—11 of FIG. 4.

Like characters of reference designate like parts in those figures of the drawings in which they occur.

In the drawings:

The reference numeral 15 indicates the apparatus, as a whole, comprising an open framework principally formed from box tubing defining a horizontal base frame means 16, an upright end frame means 18 at one end of the base frame, vertically adjustable platform means 20 at the other end portion of the base frame, and upstanding lever means 22 interposed between the end frame means and platform means and movable toward and away from the end frame.

The base frame means is generally rectangular in plan view formed by opposing parallel side members 24 and 26 joined at their rearward ends by a cross member 28 with the forward end portions of the members 24 and 26 converging and interconnected by a forward base member 30. The side members 24 and 26 are interconnected by a transverse member 32 and a pair of intermediate base members 34 and 36 extend in laterally spaced relation between the respective end portions of the forward base member 30 and transverse frame member 32. A generally T-shaped, in plan view, base plate 40 horizontally overlies and is secured to the transverse member 32 and intermediate members 34 and 36 to form a lever base or platform for supporting the lever means 22, as presently explained. Foot pads support the base frame 16 on a horizontal surface in a conventional manner.

Figure 2:
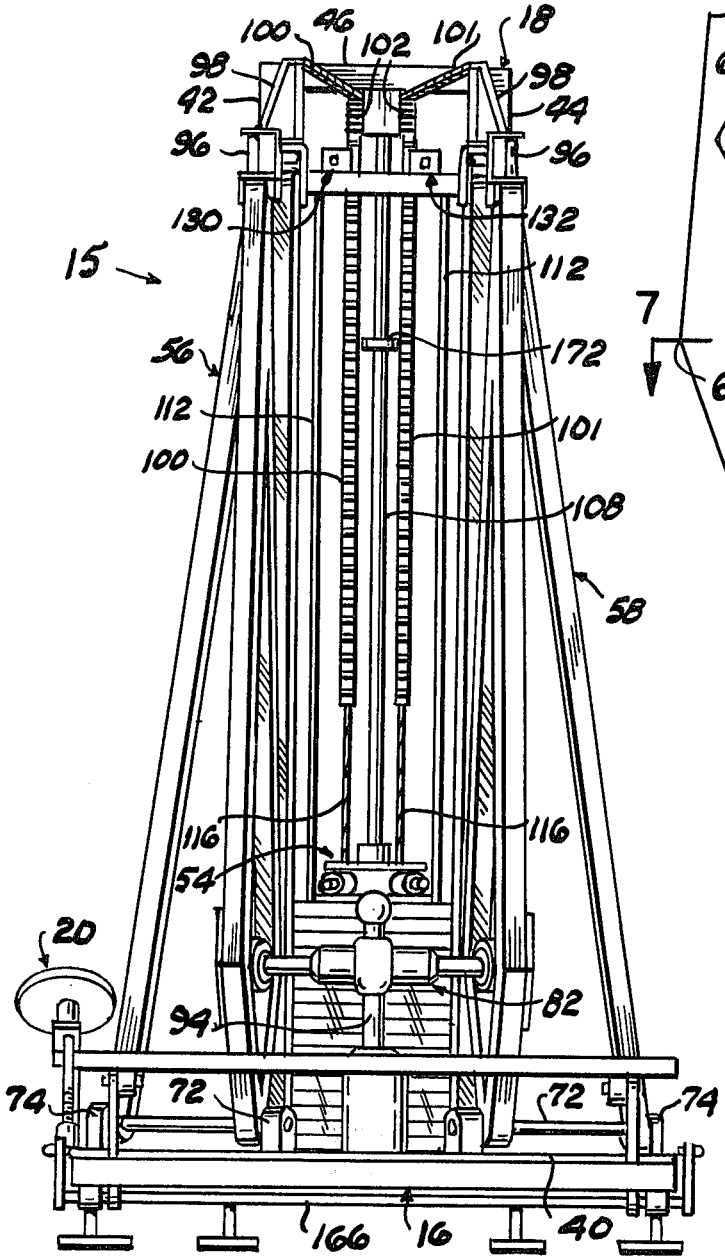
FIG. 2 is a right end elevational view of FIG. 1.
Figure 6:
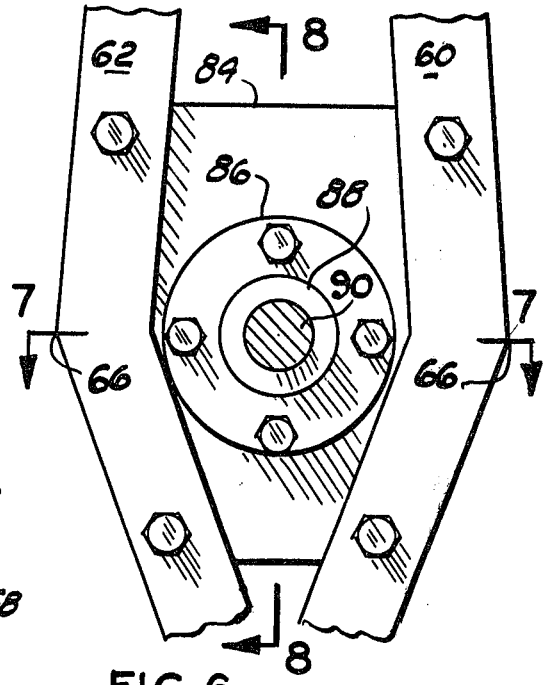
FIG. 6 is a fragmentary elevational view, to a larger scale, looking in the direction of the arrow 6—6 of FIG. 3.

The end frame means 18 comprises a pair of vertical standards 42 and 44 of selected height overlying and secured to respective end portions of the forward base member 30 at its juncture with the intermediate base members 34 and 36. The upper ends of the standards 42 and 44 are interconnected by a horizontal top member 46 (FIG. 2).

The end frame means 18 further includes a pair of end frame braces 48 and 50 extending upwardly and forward from the respective intermediate base members 34 and 36 and are respectively interconnected at their upper ends with the standards 42 and 44 by side members 52, only one being shown. Deadweight assembly means 54 overlies and is normally supported by the forward base member 30 between the standards 42 and 44 to be lifted by the lever means 22, as presently explained.

The lever means 22 comprises a pair of upstanding lever assemblies 56 and 58 disposed in laterally spaced-apart relation adjacent the rearward limit of the base plate 40. Since the lever assemblies 56 and 58 are mirror images of each other, only the lever assembly 56 is described in detail in the interest of brevity. The assembly 56 comprises a pair of elongated uprights 60 and 62 integrally connected together at their depending ends, as at 64, which diverge upwardly a selected distance, in a generally forward and rearward direction, where the uprights 60 and 62 are bent or turned toward each other, as at 66, and are rigidly connected at their upper limit and pivotally connected with a rearward clevis member 68 surrounding one end portion of a hand grip rod 69. The lever assembly 56 further includes a lever brace 70 secured, at its depending end to one end portion of a lever axle 72 secured at its other end to the juncture 64 of the lever uprights 60 and 62. Respective end portions of the lever axle 72 are journalled by upstanding lugs 74 mounted on the base plate 40 with the longitudinal axis of the lever axles of the lever assemblies 56 and 58 diverging laterally and forwardly from the longitudinal centerline of the frame base means 16. The upper end portion of the lever brace 70 is rigidly secured to the upper end portion of the lever uprights 60 and 62. The purpose of angularly disposing the lever axles 72 in diverging relation is so that the upper end portion of the lever assemblies 56 and 58 are directed toward the center of the upper end portion of the end frame means 18 when the lever assemblies are respectively moved toward and away from the end frame means for the purpose presently explained. Stated another way, the vertical planes formed by the lever uprights 60 and 62 of the lever assemblies converge toward the vertical centerline of the end frame means 18.

Figure 8:
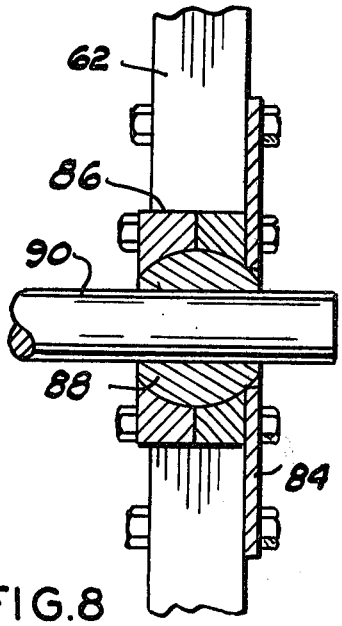
FIGS. 7 and 8 are horizontal and vertical cross sectional views, respectively, taken substantially along the lines 7—7 and 8—8 of FIG. 6.
Figure 7:
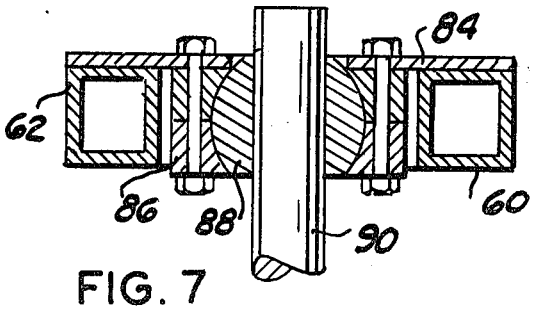
Figure 3:
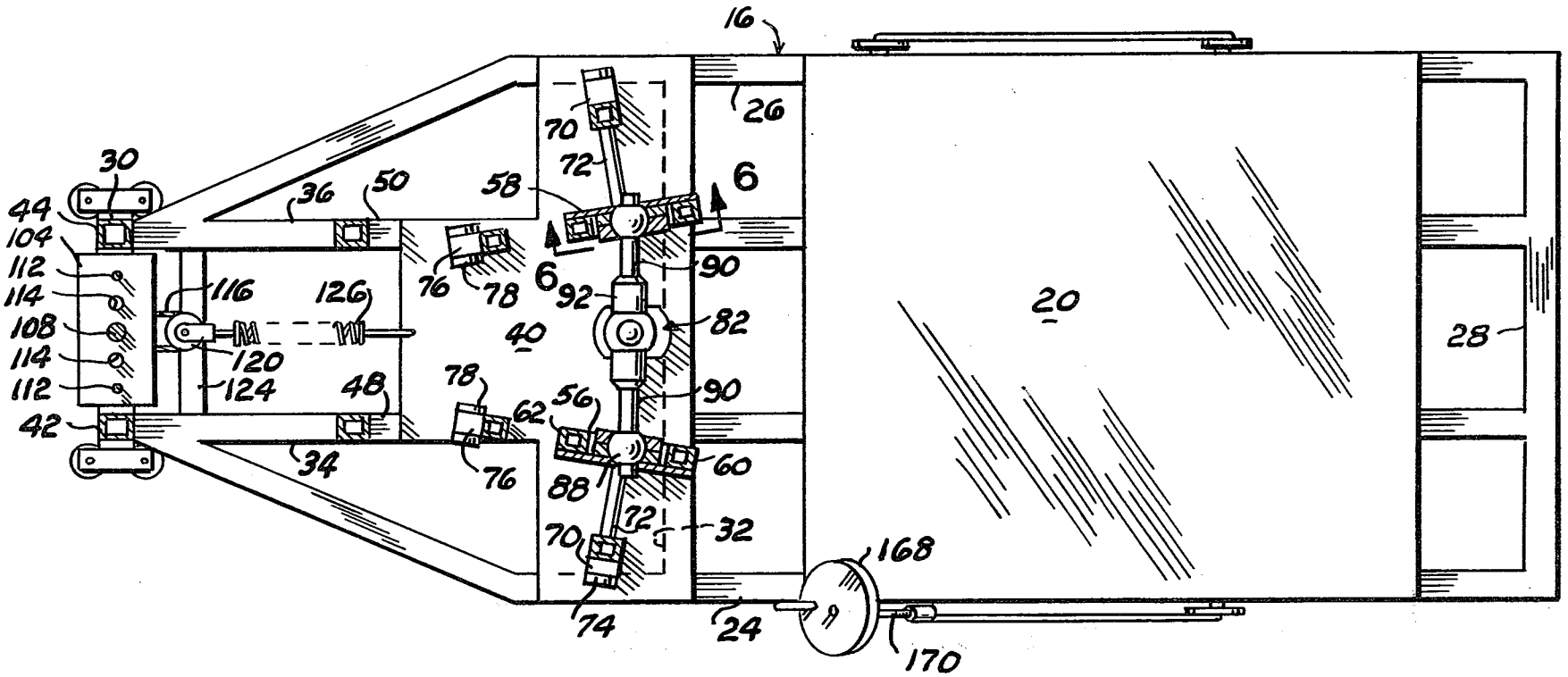
FIG. 3 is a horizontal sectional view, partially in elevation, taken substantially along the line 3—3 of FIG. 1.

The lever assembly 56 further includes a guide bar 76 coextensive with the length of the lever uprights 60 and 62 which is pivotally mounted on an upstanding lug 78 mounted on the forward end portion of the base plate 40 in alignment with the vertical plane defined by the lever uprights 60 and 62 with the upper end of the bar 76 similarly connected with a forward clevis member 80 secured to the forward end of the grip rod 69 with the longitudinal axis of the bar 76 parallel with the longitudinal axis extending between the ends of the lever uprights 60 and 62. The lever bar 76, in combination with the lever uprights 60 and 62, the grip rod 69 and frame base plate 40 form a parallelogram so that forward and rearward movement of the lever assembly 56 toward and away from the end frame means 18 maintains the grip rod 69 parallel with the horizontal plane of the frame base means 16. Centrally of their bend points 66 or transversely greatest dimension, the lever uprights 60 and 62 are interconnected by a fulcrum axle means 82 including a centrally bored lever plate 84 extending between and secured to the outer surface of the lever uprights 60 and 62 and extending upwardly and downwardly from their bend point 66. Ball and socket means 86 (FIGS. 7 and 8) is centrally secured to the inner surface of the lever plate 84 for journalling a diametrically bored ball 88. A stub axle 90 slidably projects horizontally through the ball 88 at one end portion and is axially secured at its other end portion to a horizontal fulcrum guide 92. The fulcrum guide 92 is vertically drilled medially its ends and vertically slidably surrounds a fulcrum post 94 rigidly mounted at its depending end on the frame base plate 40 medially the spacing between the inwardly disposed ends of the lever axles 72. The purpose of the fulcrum axle means 82 is to synchronize the alternate forward and rearward pivoting movement of the upper end portions of the lever assemblies 56 and 58 toward and away from the end frame means 18 and to permit the user to exercise both arms in a pulling action by one arm and a pushing action by the other arm and vise versa on the upper end portions of the lever assemblies when lifting a selected quantity of the deadweight assembly 54 in the manner presently explained.

The lever assembly means 56 further includes a hand grip 96 pivotally secured to the rearwardly projecting end portion of the grip rod 69 for angular rotation about its axis and manually moving the lever assemblies 56 and 58 in a forward and rearward direction while standing on the platform means 20. An elongated upstanding bracket 98, extending between and secured to the clevis members 68 and 80 on each lever assembly, is connected with one end of a pair of flexible elements preferably chains 100 and 101. The chains are respectively entrained over a pair of sprockets 102 depending from the end frame top member 46 for lifting a selected quantity of the deadweight means 54 as presently explained.

The deadweight assembly means 54 comprises a plurality of centrally bored plate-like rectangular weights 104 of selected mass arranged in superposed relation with the central bore surrounding a weight selector sleeve 106 (FIG. 10) secured to the uppermost plate and vertically slidable on an end frame central guide rod 108. The several weights 104 overlie and are supported by resilient means such as a spring 110 and/or rubber bumpers, not shown, interposed between the lowermost weight 104 and upper surface of the frame base member 30.

Guide rods 112 (FIG. 10), coextensive with the frame end means 18, are slidably received by longitudinally spaced-apart apertures formed in the weights 104 as is conventional with gymnastic devices featuring weights to be lifted by flexible elements entrained over pulleys, or the like. Each of the weights 104 are further provided with a pair of longitudinally spaced-apart apertures 114 disposed between the guide rods 108 and 112. The diameter of the bores 114 is sufficient to freely receive the respective depending end portion of the chains 100 and 101 for the reasons presently apparent.

Figure 9:
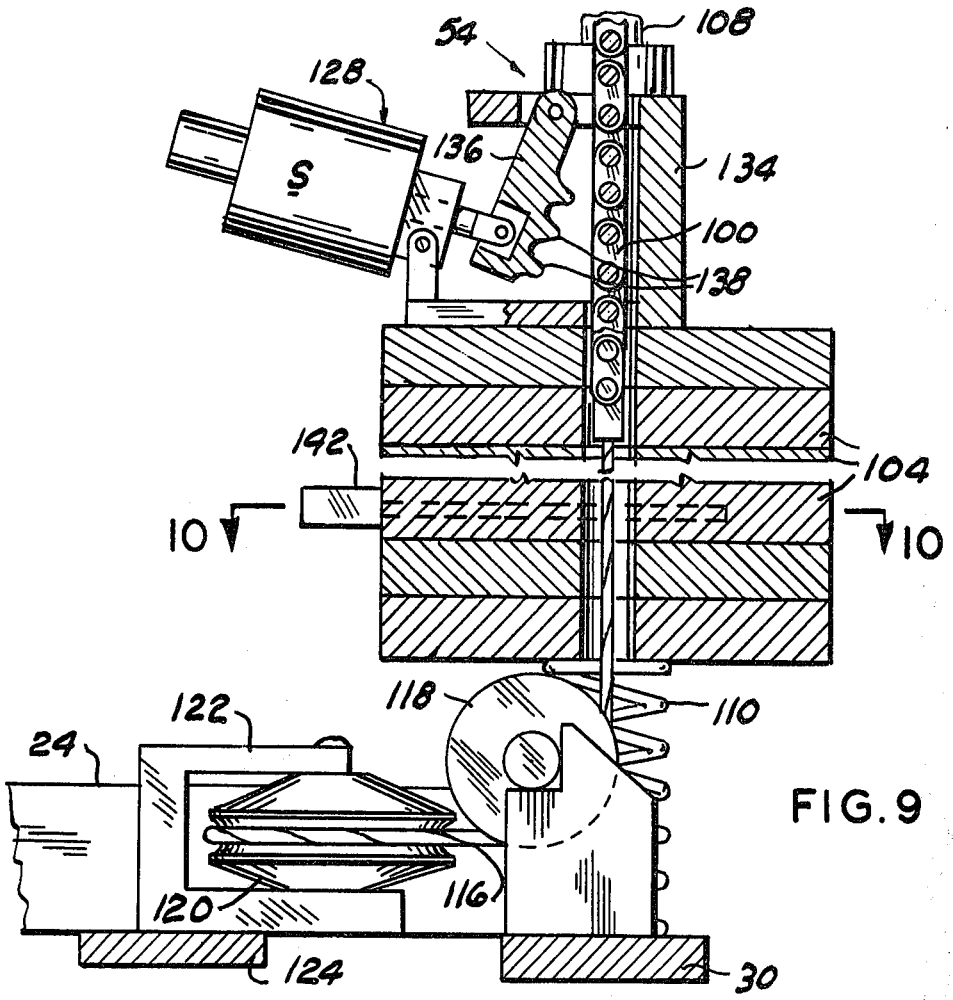
FIG. 9 is a fragmentary vertical cross sectional view taken substantially along the line 9—9 of FIG. 5.
Figure 11:
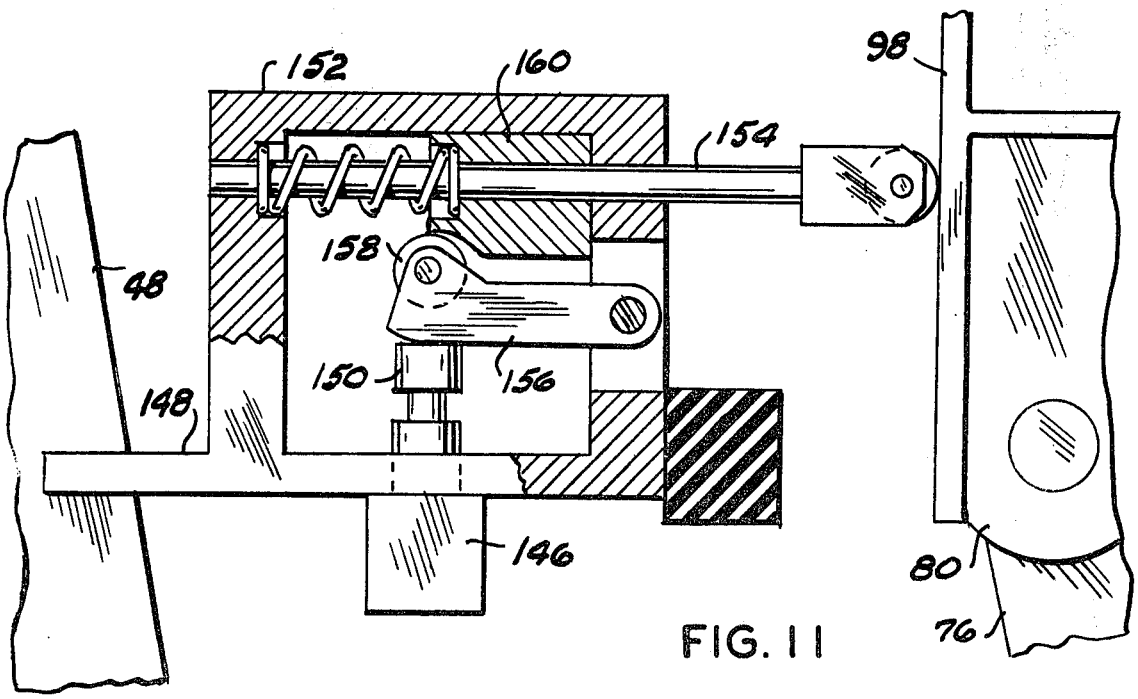

The depending end portion of each chain is connected to the respective end portion of a cable 116 extending vertically through the bores 114 and entrained over a pair of pulleys 118, only one being shown (FIG. 9), mounted on the upper surface of the frame base member 30 with an intermediate portion of the cable 116 entrained horizontally around a slack take-up pulley 120 journalled by a C-shaped bracket 122 slidably supported by a transverse base frame brace 124 and connected with the forward end portion of the frame base plate 40 by a resilient member 126 which maintains the chains and cable taut. When the lever assemblies 56 and 58 are in the position of FIG. 1, the depending end of each of the chains 100 and 101 are disposed in spaced relation above the deadweight means 54 (FIG. 2).

A pair of solenoid means 128 and 129 are mounted on and secured to the uppermost weight 104 for engaging the depending end portion of the respective chain 100 and 101 and lifting a selected number of weights 104. The solenoid means is energized by the lever assemblies 56 and 58, respectively, contacting a pair of end frame supported switch means 130 and 132 connected with a source of electrical energy, not shown, as presently explained.

The solenoid means 128 and 129 are identical and each comprise a bracket 134 extending longitudinally of the upper limit of the weights 104 which supports a pivoting pawl 136 having a plurality of vertically spaced-apart teeth 138 facing toward the depending end portion of one of the chains for entering the spacing between the rollers of the chain 100. A bracket supported solenoid S has its plunger 140 pivotally secured to the depending end portion of the pawl 136 for moving the pawl toward and away from the chain by the "on" and "off" position of the switches 130 and 132. When the solenoid S is energized to engage the pawl 136 with the chain, upward movement of the chain, by rearward movement of the lever assembly 56, lifts the solenoid means 128 and 129, the selector sleeve 106 and a selected number of the weights 104. The number of weights to be lifted by upward movement of the chain is selected by the placement of a U-shaped member 142 having parallel rod-like prongs 144 entering cooperating bores extending laterally inward from a common side of each of the weights 104 (FIG. 10) which cooperatively engage partcircular diametrically opposed recesses 145 formed in the outer surface of the selector sleeve 106 thus lifting all of the weights disposed above the position of the U-shaped selector 142.

The switch means 130 and 132 each comprise push button type switches 146 mounted on a bracket 148 supported by the end frame braces 48–50. Each of the switches 146 includes a button or plunger 150 which, when axially moved, turns the switch "on" or "off". Switch housing means 152 is mounted on the bracket means 148 and includes a horizontally disposed switch actuator rod 154 normally spring urged rearwardly toward the path of movement of the respective lever assemblies 56 and 58. A switch pawl 156, pivotally mounted, at one end portion, by the switch housing 152 and overlying, at its other end portion, the switch button 150, is provided with a friction reducing roller 158 opposite the switch button 150 and adjacent the shaft 154. A cam 160, secured to the shaft 154, pivots the switch pawl 156 downwardly when the shaft 154 is moved forwardly to open or close the switch 146 and energize the respective solenoid S.

The frame platform means 20 comprises a planar platform 162 maintained in selected spaced relation above the horizontal plane of the base frame 16 by a plurality of arms 164 pivotally connected at their upper ends with the depending surface of the platform 162 and rigidly connected at their lower ends with a pair of shafts 166 extending transversely of the depending surface of the base frame. A bracket supported platform adjusting wheel 168 includes a screw shaft 170 operatively connected with the forward shaft 166 which angularly rotates the shaft for raising or lowering the platform 162 in a conventional manner.

OPERATION

Figure 4:
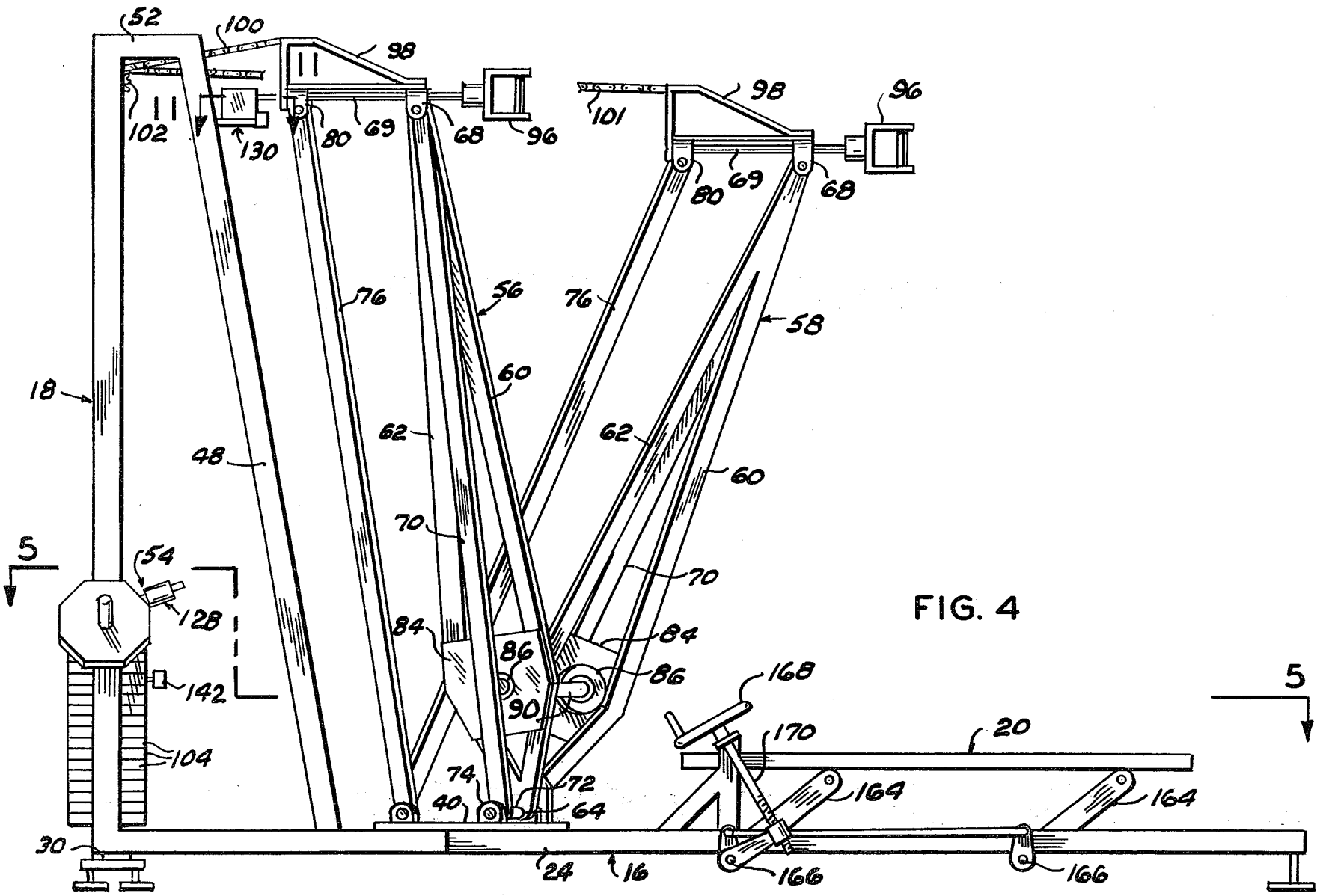
FIG. 4 is a view similar to FIG. 1 illustrating the lever assemblies when moved to a weight pick up or release position.
Figure 5:
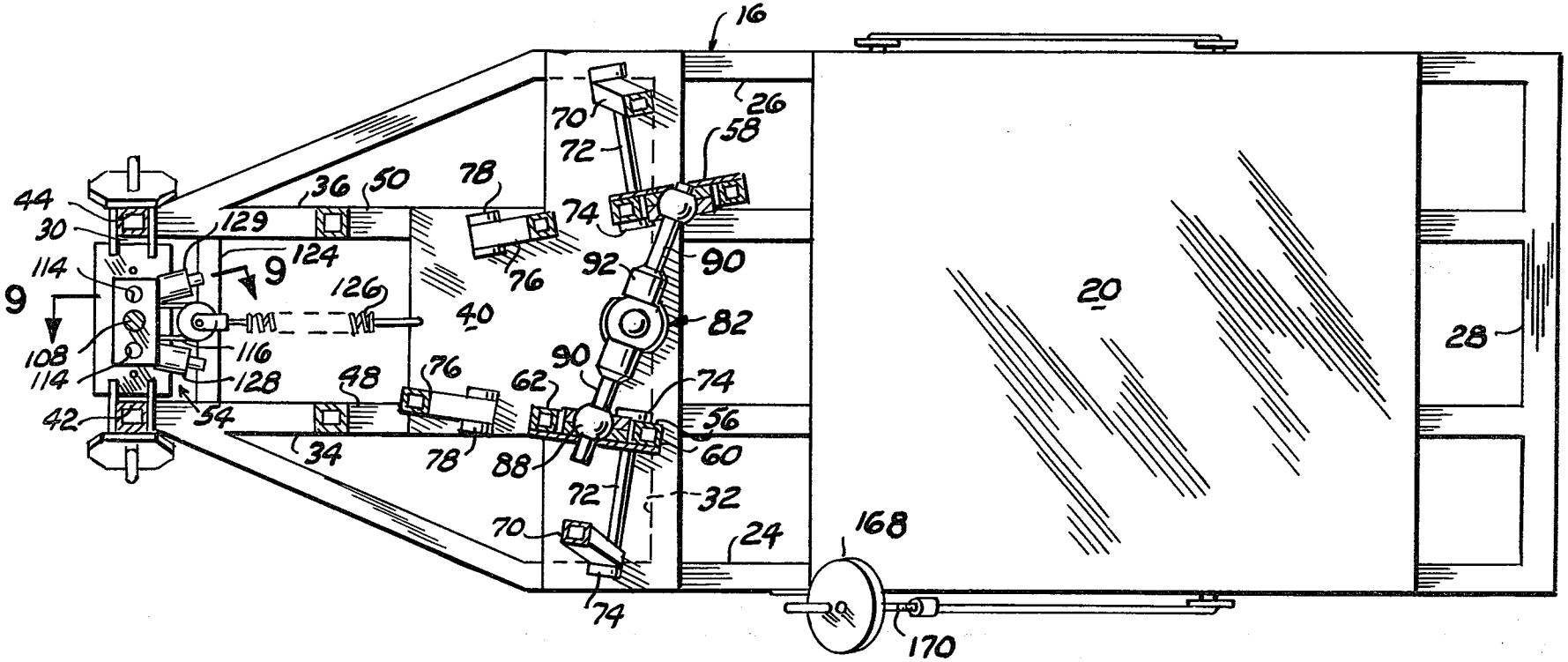
FIG. 5 is a horizontal cross sectional view, partially in elevation, taken substantially along the line 5—5 of FIG. 4.

In operation, the platform 162 is adjusted so that the user's hands may comfortably grip the respective hand grips 96. The weight selector member 142 is inserted into a selected one of the weights 104. The operator then moves one of the lever assemblies, for example, the assembly 56, forwardly toward the frame end means 18 until the forward end of the bracket 98 contacts the switch shaft 154 biasing the switch pawl 156 thus energizing the solenoid of the solenoid means 128 and engaging the chain pawl 156 with the depending end portion of the chain 100. Simultaneously with the forward movement of the lever assembly 56, the other lever assembly 58 is moved rearwardly by the fulcrum axle means 82, as illustrated by FIGS. 4 and 5. The lever assembly 56 is then pulled rearwardly by the operator which, by the chain and cable means, lifts the selected quantity of the weights in a sliding action along the rods 108 and 112 with upward movement of the weights limited by a stop 172 surrounding the rod 108. While pulling the lever assembly 56 rearwardly, the operator pushes the lever assembly 58 forwardly in which the pushing force is transferred to the lever assembly 56 by the fulcrum axle means 72.

As best illustrated in FIG. 5, the converging planes in which the lever assemblies 56 and 58 are pivoted results in the ball joint connection 86 of the respective lever assembly when in its rearwardmost position being disposed a greater distance from the vertical axis of the fulcrum post 94 than the ball joint connection 86 of the other forwardly disposed lever assembly. This provides a fulcrum lever advantage wherein by pushing on the rearwardmost lever assembly the operator is enabled to lift a greater quantity of the weights 104 than would ordinarily be possible without such leverage advantage.

The purpose of the stop 172 is to prevent the bracket 98 of the forwardly moving lever assembly 58 closing the switch means 132 which would energize the other chain pawl 136 and lock the forward and rearward movement of the lever assemblies. After rearward movement of the lever assembly 56, limited by the stop 172, the operator then moves the lever assemblies in their first direction of movement until the bracket 98 of the lever assembly 56 again contacts the switch means 130 which releases the solenoid means 128. Rearward movement of the lever assembly 56 and forward movement of the lever assembly 58, then closes the other switch means 132 to repeat the cycle of operation. This action continues in a like manner, as desired.

Obviously the invention is susceptible to changes or alterations without defeating its practicability. Therefore, I do not wish to be confined to the preferred embodiment shown in the drawings and described herein.

I claim:

1. A weight raising exercise device, comprising:

horizontal base frame means;

upstanding end frame means at one end of the base frame means;

superposed weight means including a plurality of horizontal vertically bored weights supported by said base frame means for vertical sliding movement within said end frame means;

two separate hand grip equipped laterally spaced upstanding lever means pivotally supported by said base frame means intermediate its ends for movement of their upper end portions toward and away from said end frame means;

fulcrum axle means mounted on said base frame means and pivotally connected with the depending end portion of said lever means for pivoting one said lever means away from said end frame means when the other said lever means is pivoted toward said end frame means and vice versa;

flexible elements secured to the respective upper limit of said lever means and entrained through the bores in said weights and over pulley-like means mounted on respective upper and lower end portions of said end frame means; and, solenoid means connected with a source of electrical energy and mounted on said weight means for connecting at least one said weight with respective intermediate portions of said flexible elements when said lever means are respectively pivoted a predetermined distance toward said end frame means.

2. The exercise device according to claim 1 in which said fulcrum axle means includes:

a generally vertical post mounted on said base frame medially the spacing between said lever means;

axle guide means surrounding an intermediate portion of said post for horizontal pivoting and vertical sliding movement;

a pair of axles secured to opposite sides of said guide in horizontal axial alignment; and, ball and socket means connecting one end portion of said pair of axles with the respective said lever means.

3. The exercise device according to claim 2 in which said flexible elements include:

a pair of chains respectively extending from said lever means to a point intermediate the height of said end frame means; and, a cable interconnecting the ends of said pair of chains opposite the lever means, whereby the end portion of said pair of chains respectively enter the bores of said weights in response to movement of the respective said lever means a predetermined distance toward said end frame means.

4. The exercise device according to claim 3 in which said solenoid means includes:

bracket means overlying the uppermost weight of said plurality of weight;

a pawl pivotally supported by said bracket means adjacent the path of movement of said chains through said plurality of weights; and, a pair of solenoids supported by said bracket means and operatively connected with the respective said pawl for releasably engaging said pawls with the respective said chain.

5. The exercise device according to claim 4 in which said solenoid means further includes:

switch means operatively connected with said solenoids and supported by said end frame means in the path of movement of said lever means for energizing and deenergizing said solenoids.

6. The exercise device according to claim 5 and further including:

platform means vertically adjustably supported horizontally by the end portion of said base frame means opposite the end frame means.

* * * * *